US008346112B2

(12) United States Patent
Hachisuka

(10) Patent No.: US 8,346,112 B2
(45) Date of Patent: Jan. 1, 2013

(54) COOLING MEMBER INCLUDED FIXING DEVICE AND IMAGE FORMING APPARATUS

(75) Inventor: Toshiharu Hachisuka, Yokohama (JP)

(73) Assignee: Ricoh Company, Ltd., Tokyo (JP)

( * ) Notice: Subject to any disclaimer, the term of this patent is extended or adjusted under 35 U.S.C. 154(b) by 532 days.

(21) Appl. No.: 12/605,814

(22) Filed: Oct. 26, 2009

(65) Prior Publication Data

US 2010/0104298 A1 Apr. 29, 2010

(30) Foreign Application Priority Data

Oct. 27, 2008 (JP) ..... 2008-276052

(51) Int. Cl.
*G03G 15/20* (2006.01)

(52) U.S. Cl. ..... 399/69; 399/33; 399/44; 399/88

(58) Field of Classification Search ..... 399/33, 399/44, 46, 67, 69, 70, 88, 90, 94, 320
See application file for complete search history.

(56) References Cited

U.S. PATENT DOCUMENTS

| | | | | |
|---|---|---|---|---|
| 6,405,002 | B2 | 6/2002 | Ogiyama et al. | |
| 6,539,185 | B2 * | 3/2003 | Hanyu et al. | 399/67 |
| 6,577,840 | B2 | 6/2003 | Hachisuka et al. | |
| 6,865,363 | B2 | 3/2005 | Hachisuka et al. | |
| 7,127,204 | B2 | 10/2006 | Satoh et al. | |
| 7,313,353 | B2 | 12/2007 | Satoh et al. | |
| 2006/0263122 | A1 | 11/2006 | Hachisuka | |
| 2007/0196119 | A1 * | 8/2007 | Fujita | 399/68 |
| 2008/0075494 | A1 * | 3/2008 | Matsuo | 399/70 |
| 2008/0253789 | A1 | 10/2008 | Yoshinaga et al. | |
| 2009/0016760 | A1 | 1/2009 | Hachisuka | |

FOREIGN PATENT DOCUMENTS

| | | |
|---|---|---|
| JP | 2000-75707 | 3/2000 |
| JP | 2004-102104 | 4/2004 |
| JP | 2005-37539 | 2/2005 |
| JP | 2006-119430 | 5/2006 |
| JP | 2006-172781 | 6/2006 |
| JP | 2006-227374 | 8/2006 |

* cited by examiner

*Primary Examiner* — Walter L Lindsay, Jr.
*Assistant Examiner* — Jessica L Eley
(74) *Attorney, Agent, or Firm* — Oblon, Spivak, McClelland, Maier & Neustadt, L.L.P.

(57) ABSTRACT

A fixing device includes a heating member that heats an unfixed toner image on a printing medium, a conveyance device that conveys the printing medium launched from the heating member after the heating member heats the unfixed toner image, and a heat temperature detection device that detects heat temperature of the heating member. An excessive temperature rise prevention device is provided to forcibly cut off power distribution to the heating member when the heat temperature reaches an abnormal level. A cooling device is provided to cool the excessive temperature rise prevention device. Further provided is a cooling device use control device that controls the cooling device to cool the excessive temperature rise prevention device when the conveyance device stops a conveyance operation.

8 Claims, 9 Drawing Sheets

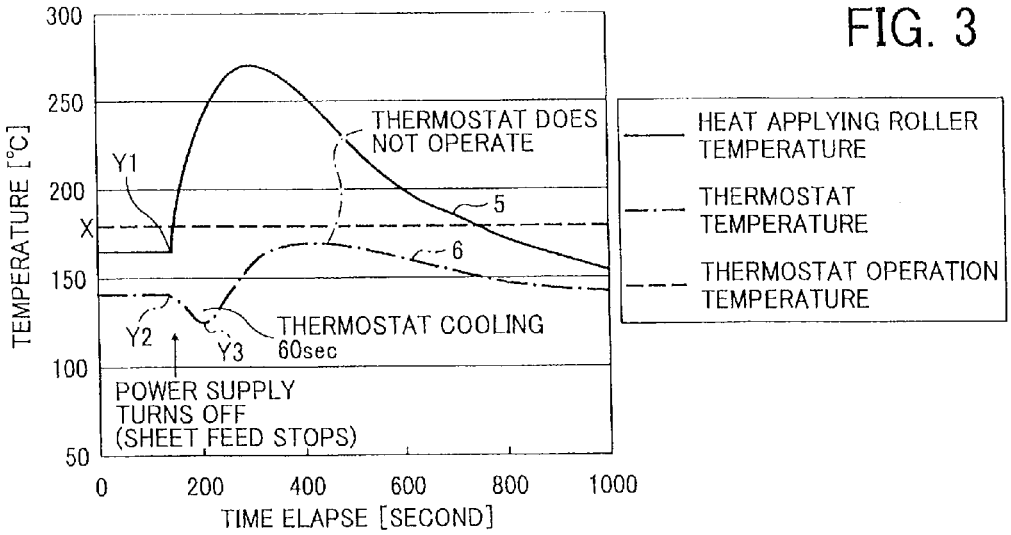
FIG. 3
TEMPERATURE [°C]
300
250
200
X
150
100
50
0
200
400
600
800
1000
TIME ELAPSE [SECOND]
Y1
Y2
Y3
5
6
THERMOSTAT DOES NOT OPERATE
THERMOSTAT COOLING 60sec
POWER SUPPLY TURNS OFF (SHEET FEED STOPS)
HEAT APPLYING ROLLER TEMPERATURE
THERMOSTAT TEMPERATURE
THERMOSTAT OPERATION TEMPERATURE

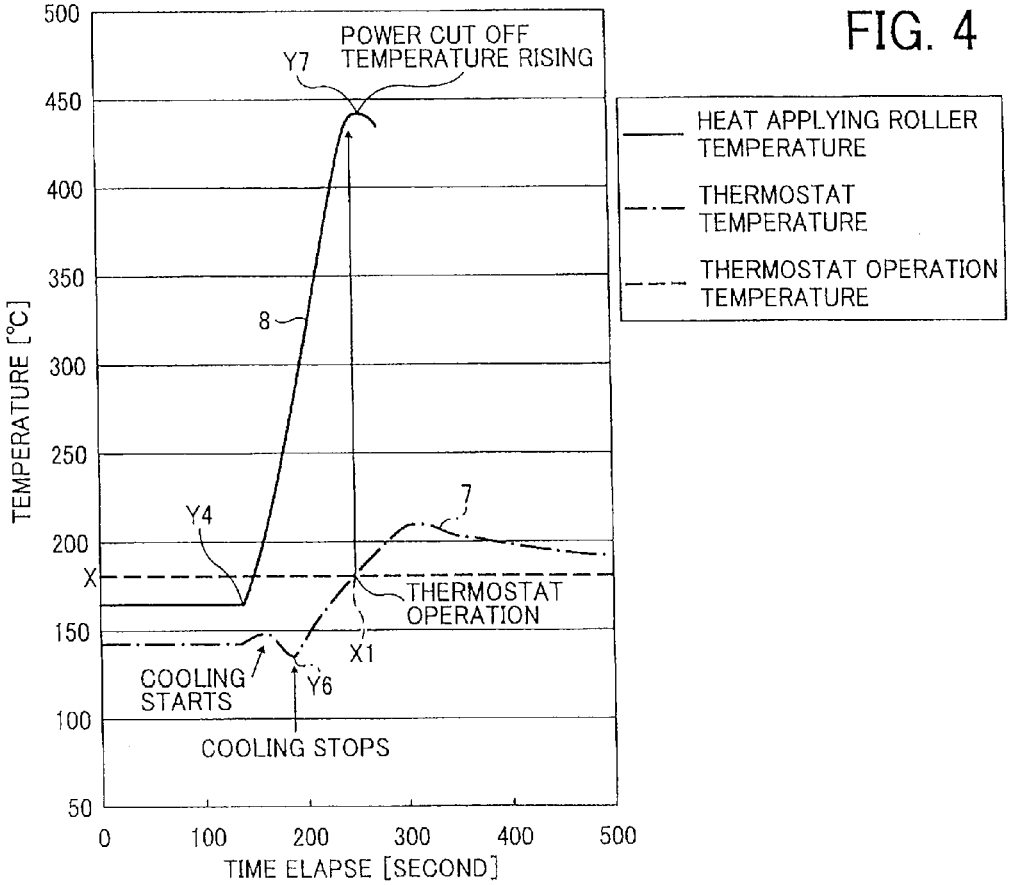
FIG. 4
TEMPERATURE [°C]
500
450
400
350
300
250
200
X
150
100
50
0
100
200
300
400
500
TIME ELAPSE [SECOND]
Y7
POWER CUT OFF TEMPERATURE RISING
8
Y4
7
THERMOSTAT OPERATION
X1
Y6
COOLING STARTS
COOLING STOPS
HEAT APPLYING ROLLER TEMPERATURE
THERMOSTAT TEMPERATURE
THERMOSTAT OPERATION TEMPERATURE

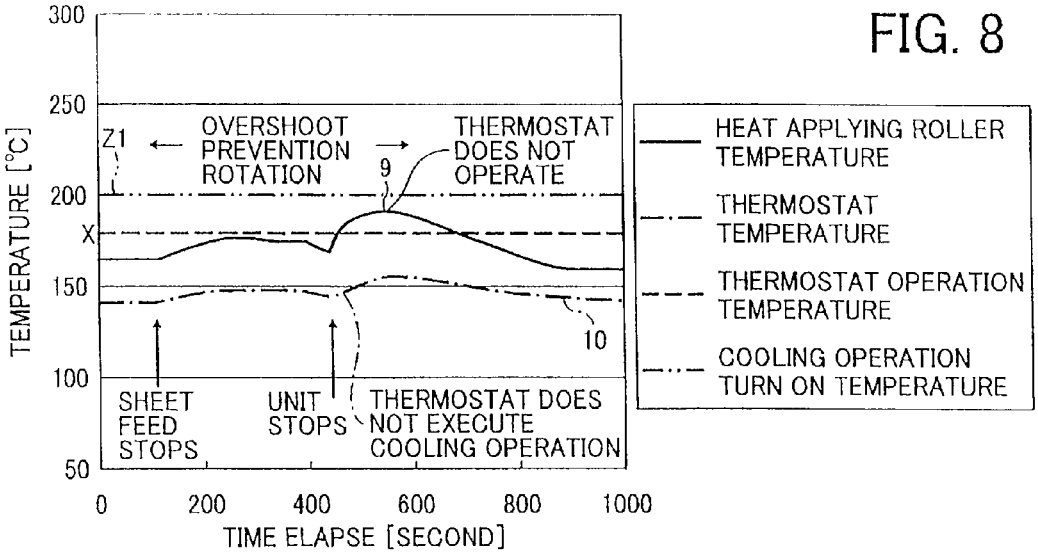
FIG. 8
300
250
200
150
100
50
TEMPERATURE [°C]
Z1
X
OVERSHOOT PREVENTION ROTATION
THERMOSTAT DOES NOT OPERATE
9
10
SHEET FEED STOPS
UNIT STOPS
THERMOSTAT DOES NOT EXECUTE COOLING OPERATION
0
200
400
600
800
1000
TIME ELAPSE [SECOND]
HEAT APPLYING ROLLER TEMPERATURE
THERMOSTAT TEMPERATURE
THERMOSTAT OPERATION TEMPERATURE
COOLING OPERATION TURN ON TEMPERATURE

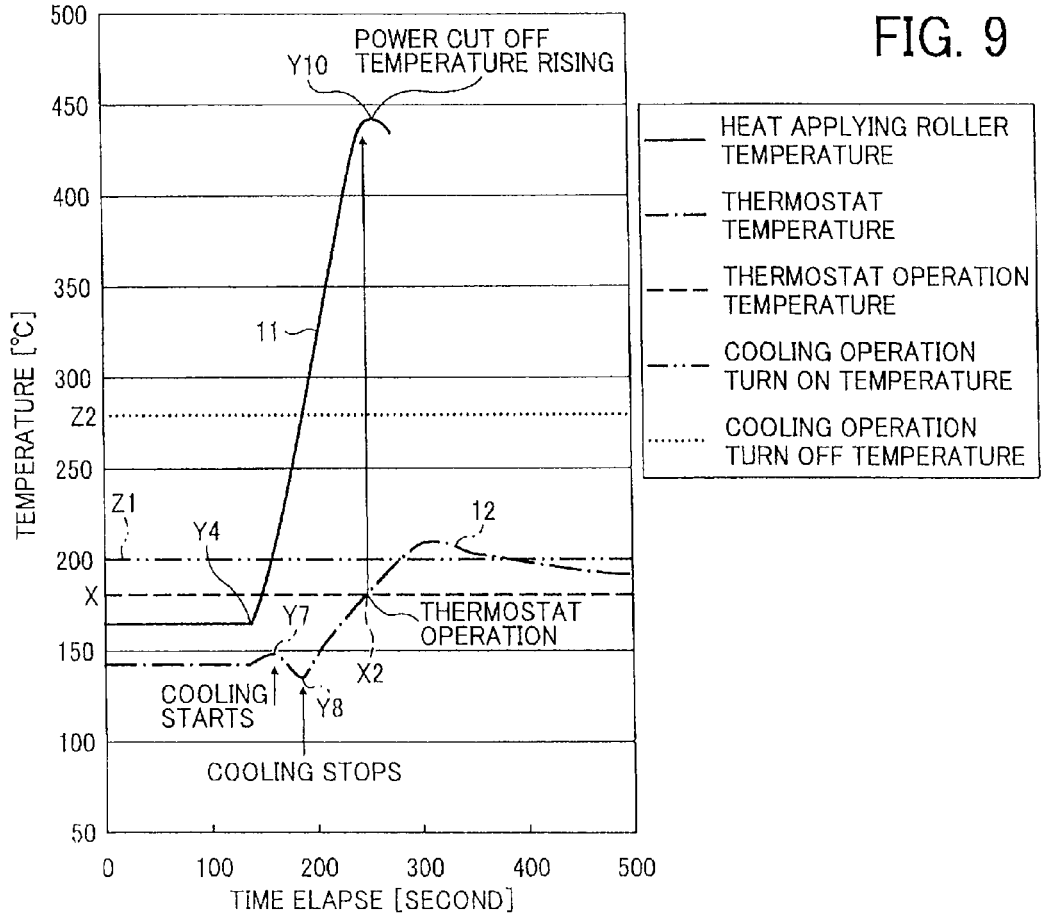
FIG. 9
500
450
400
350
300
250
200
150
100
50
TEMPERATURE [°C]
POWER CUT OFF TEMPERATURE RISING
Y10
11
Z2
Z1
Y4
12
X
Y7
THERMOSTAT OPERATION
X2
COOLING STARTS
Y8
COOLING STOPS
0
100
200
300
400
500
TIME ELAPSE [SECOND]
HEAT APPLYING ROLLER TEMPERATURE
THERMOSTAT TEMPERATURE
THERMOSTAT OPERATION TEMPERATURE
COOLING OPERATION TURN ON TEMPERATURE
COOLING OPERATION TURN OFF TEMPERATURE

COOLING MEMBER INCLUDED FIXING DEVICE AND IMAGE FORMING APPARATUS

CROSS REFERENCE TO THE RELATED APPLICATION

This application claims priority under 35 USC §119 to Japanese Patent Application No. 2008-276052, filed on Oct. 27, 2008, the entire contents of which are herein incorporated by reference.

BACKGROUND OF THE INVENTION

1. Field of the Invention

The present invention relates to a fixing device having an excessive temperature rise prevention member and an image forming apparatus including the fixing device.

2. Discussion of the Background Art

In the past, it is well known that temperature of a heating member included in a fixing device of an image forming apparatus, such as a copier, a printer, etc., sometimes excessively increases and damages the fixing device and/or creates an abnormal image when a printing operation is completed as discussed in the Japanese Patent Application Laid Open Nos. 2004-102104 and 2000-75707.

Specifically, the fixing device includes a heating roller heated by either a heater or an electromagnetic induction heating system and a fixing roller serving as a heating member. In such a device, heat is absorbed by a printing medium via a fixing member, such as a fixing belt, a fixing roller, etc., during a printing operation, and temperature of a heating member does not abnormally increases. However, since heat stored in a core metal or the like included in the heating member suddenly stops traveling to the printing medium right after completion of the print operation, temperature of the heating member abnormally increases and causes so called overshoot. This tends to happen immediately when a consecutive printing operation is terminated. Further, the higher the printing speed (i.e., cpm) or the larger the basic weight of the printing medium conveyed, the more problem occurs.

To prevent such overshoot, various attempts have been presented. For example, the Japanese Patent Application Laid Open No. 2004-102104 discusses that a heating operation for heating printing mediums in a print job is stopped before printing of the last page thereof is completed. The Japanese Patent Application Laid Open No. 2000-75707 discusses that a cooling fan cools a fixing roller when a temperature detection device arranged on a fixing roller detects prescribed temperature. The Japanese Patent Application Laid Open No. 2006-227374 discusses that air is blown and cools a surface of a heating roller at the end of printing. The Japanese Patent Application Laid Open No. 2006-119430 discusses that temperature of a region of a heating member, where a printing medium does not pass through, is detected after the end of consecutive printing, and a cooling fan blows cooling air to the heating member when more than a prescribed temperature is detected.

In the above-mentioned various conventional arts, the overshoot can be effectively suppressed as far as the cooling fan normally operates. However, when the cooling fan goes wrong and impossible to provide the cooling air to the heating member, temperature of the heating member increases and overshoot cannot be suppressed. To resolve such a problem, an excessive temperature rise prevention device including a thermostat (TM) is provided in the vicinity of the heating member to forcibly cut off power distribution to the heating member when temperature of the heating member excessively increases as discussed in the Japanese Patent Application Laid Open No. 2006-119430.

So as to appropriately operate an excessive temperature rise prevention device, a cooling fan is provided to blow cooling air to the excessive temperature rise prevention device during a normal printing operation so that the excessive temperature rise prevention device does not go wrong as discussed in the Japanese Patent Application Laid Open No. 2006-172781. When a temperature detection device provided in the vicinity of the heating member detects a prescribed level, the cooling fan stops operation, and the excessive temperature rise prevention device starts operation and cuts off the power distribution to the heating member.

The cooling fan of the Japanese Patent Application Laid No. 2006-172781 operates when a printing medium is conveyed and receives printing, but stops the operation when the printing medium is stopped conveying and receiving the same. Since heat is not absorbed from the heating member to the printing medium when power distribution is stopped as the printing operation stops, temperature of the heating member and the excessive temperature rise prevention device increase. As a result, the excessive temperature rise prevention device is forcibly turned on. The cut off condition of the power distribution is sometimes maintained even when the power supply to the heating member is turned off, and it is impossible to restart power supplying even it is repeatedly attempted. As a result, repair is needed to initialize a system.

Now, an erroneous operation of the excessive temperature rise prevention device is described with reference to FIG. 10. As shown, a conventional fixing device 1 includes a halogen lamp 2 serving as a heating member, a temperature detection device 3, such as a thermister, etc., an excessive temperature rise prevention device 4 having a thermostat (TM), a cooling device 5 having an air blower fan, and a control device 6. When a heating roller 7 serving as a heated member is normally heated, i.e., when a printing medium is conveyed and receives printing, the control device 6 controls the cooling device 5 to cool down and maintains the excessive temperature rise prevention device in a low temperature. When the temperature detection device 3 detects a prescribed surface temperature of the heating roller 7, the control device 6 turns off and stops the cooling device 5 to cool the excessive temperature rise prevention device 4. As a result, temperature of the excessive temperature rise prevention device 4 sharply increases, and forcibly cuts off power distribution to the halogen lamp 2. Accordingly, the heating roller 7 is prevented from abnormally increasing its temperature (i.e., overshoot). In these days, a color copier is expected to speed. For example, a conventional color copier having a performance of 40 cpm increases its temperature up to about 230 degree centigrade when causing overshoot as indicated by a curvature 1 in FIG. 11. Whereas a recent color copier having a performance of more than 75 cpm increases its temperature to about 270 degree centigrade when causing the same as indicated by a curvature 2. Specifically, as the color copier is speeded, temperature at the overshoot increases as understood from the drawing.

Further, in view of energy saving of recent tendency, a warm up time needed for a fixing section is expected to be short. Thus, a heating roller 7 is increasingly thinned and employs a heater capable of starting up at high speed. However, such speeding by thinning extraordinarily narrows applicability of the excessive temperature rise prevention device 4 having the thermostat or the like. Specifically, to ensure the prevention of excessive temperature rise of the fixing device 1 owing to overdrive at the time of start up, a thermostat operable at low temperature is needed. That is, a temperature rise speed of a bimetal section of the thermostat is slower in comparison with that of the heating roller. When the low temperature operation performance thermostat is used as an excessive temperature rise prevention device and a printing operation of the fixing device is completed and a printing medium is not conveyed, temperature of the heating roller 7 increases, and the thermostat unexpectedly starts an operation. Then, the thermostat forcibly highly provably cuts off power distribution to the halogen lamp 2, erroneously. Such a forcible cutting off operation is hardly initialized and needs repair by an expert person. Such a phenomenon tends to occur either when a printing medium is jammed on a printing medium conveyance path of the image forming apparatus or when electric service stops.

Temperature changes in the heating roller 7 having the thermostat as a temperature rise prevention device are now described with reference to curvatures of FIG. 12. A shown, the thermostat starts an operation at temperature X, such as 190 degree centigrade. As understood therefrom, the thermostat possibly erroneously operates after the fixing device 1 stops printing in the above-mentioned conventional fixing device.

Specifically, since the cooling device 5 stops when the heating roller 7 stops feeding a sheet, temperature of the thermostat increases as shown by the curvature 4 as that of the heating roller 7 increases as indicated by the curvature 3. Then, the thermostat reaches the operation temperature X (e.g. X1) and is activated, thereby forcibly cutting off power distribution to the halogen lamp 2. As a result, the power distribution to the halogen lamp 2 is stopped due to stop of the printing operation. However, the forcible cutting off condition is maintained and cannot be initialized even if it is attempted to supply power and start printing. To initialize and recover the power distribution to the halogen lamp, the private repair specialist should be called.

SUMMARY OF THE INVENTION

Accordingly, an object of the present invention is to address and resolve such and other problems and provide a new and novel fixing device and image forming apparatus. Such a new and novel fixing device and image forming apparatus includes a heating member that heats an unfixed toner image on a printing medium, a conveyance device that conveys the printing medium launched from the heating member after the heating member heats the unfixed toner image, and a heat temperature detection device that detects heat temperature of the heating member. An excessive temperature rise prevention device is provided to forcibly cut off power distribution to the heating member when the heat temperature reaches an abnormal level. A cooling device is also provided to cool the excessive temperature rise prevention device. Further provided is a cooling device control device that controls the cooling device to cool the excessive temperature rise prevention device when the conveyance device stops a conveyance operation.

In another embodiment, a heating member use power supply is provided to supply power to the heating member. A cooling device control device use power supply is also provided to supply power to the cooling device control device. The cooling device control device use power supply is provided independently from the heating member use power supply.

In yet another embodiment, the cooling device control device use power supply includes battery.

In yet another embodiment, the cooling device control device use power supply includes a rechargeable battery, a charging device that charges the rechargeable battery. The charging device is supplied with power from the heating member use power supply.

In yet another embodiment, the cooling device is controlled to stop operation when the heat temperature not more than a prescribed first level is detected.

In yet another embodiment, the cooling device is controlled to stop operation when the heat temperature not less than a prescribed second level is detected.

BRIEF DESCRIPTION OF DRAWINGS

A more complete appreciation of the present invention and many of the attendant advantages thereof will be readily obtained as the same becomes better understood by reference to the following detailed description when considered in connection with the accompanying drawings, wherein:

FIG. 3 illustrates exemplary temperature change of a heating roller and a thermostat arranged in the fixing device according to a first embodiment of the present invention;

FIG. 4 illustrates an exemplary relation between temperature change of the heating roller and overshoot of the thermostat arranged in the fixing device according to the first embodiment of the present invention;

FIG. 8 illustrates exemplary temperature change of a heating roller and a thermostat arranged in the fixing device according to the fourth embodiment of the present invention;

FIG. 9 illustrates an exemplary relation between temperature change of the heating roller and overshoot of the thermostat arranged in the fixing device according to the fourth embodiment of the present invention;

DESCRIPTION OF THE PREFERRED EMBODIMENTS

Figure 1:
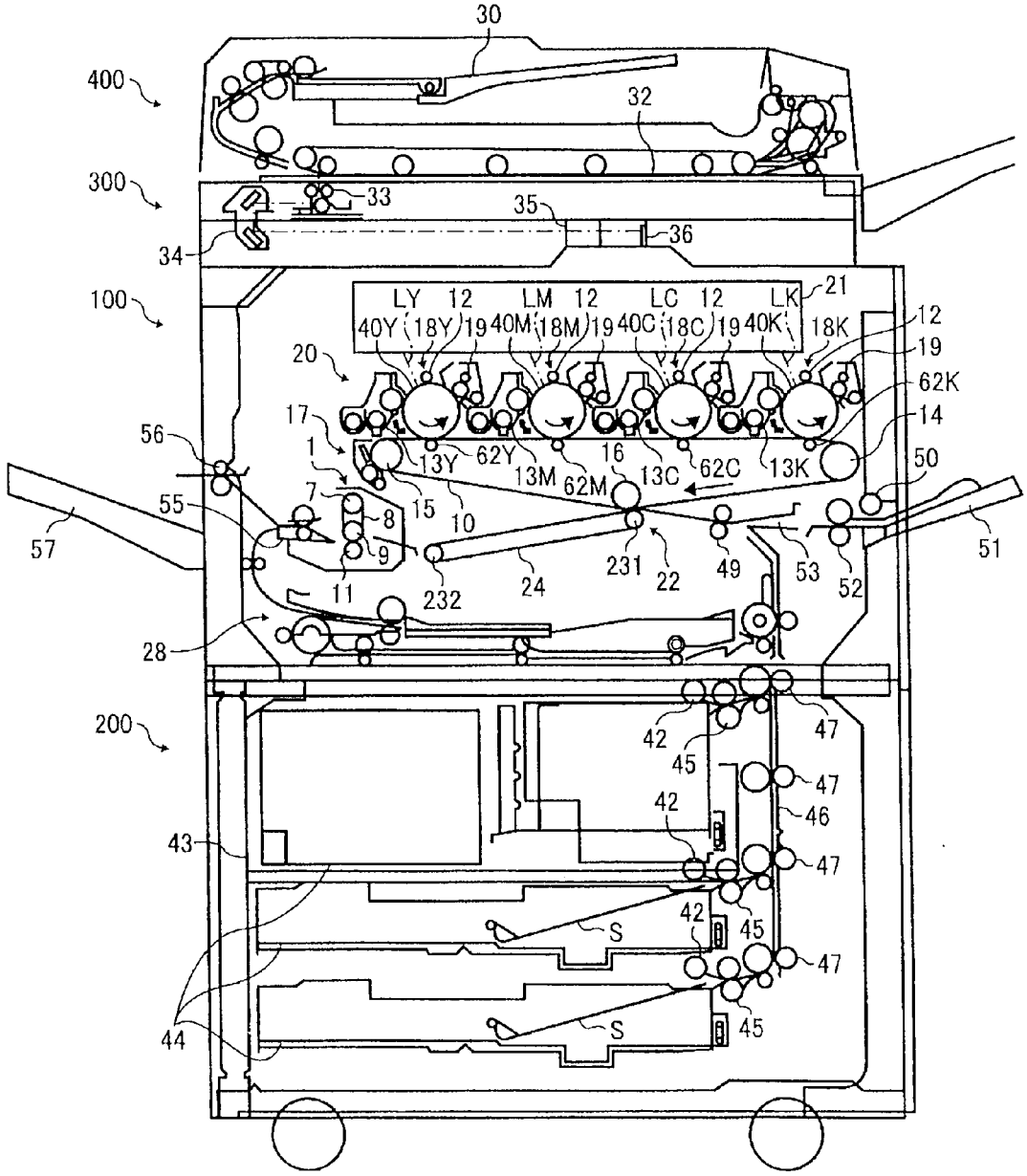
FIG. 1 schematically illustrates an exemplary copier as an image forming apparatus according to one embodiment of the present invention.

Referring now to the drawing, wherein like reference numerals designate identical or corresponding parts throughout several views, in particular, in FIG. 1, a copier as an image forming apparatus according to one embodiment is described. As shown, 100 denotes a copier body. 200 denotes a sheet feeding tray mounting the copier 100. 300 denotes a scanner attached to the copier body 100. 400 denotes an automatic document feeder attached to the scanner 300. The copier is a tandem type and employs an electro photographic system with an intermediate transfer (indirect transfer) device. An endless belt as an intermediate transfer belt 10 is arranged in the center of the copier body 100. The intermediate transfer belt 10 is wound around plural supporting rollers 14 to 16 and rotates clockwise as shown. On the left side of the second supporting roller among the three, there is provided an intermediate transfer belt cleaning device 17 removing toner remaining on the intermediate transfer belt 10 after an image transfer process. Further, along a part of the intermediate transfer belt extending over the first and second supporting rollers 14 and 15, there is provided a tandem type image formation section 20 serving as an image formation device in which four image formation sections 18Y to 18K are arranged side by side for respective mono colors of Y to K.

In this embodiment, the third roller 16 has a driving force for driving the other rollers. Above the tandem image formation section 20, there is provided an exposure device 21 that emits exposure lights of LY, LM, LC, and LK to photoconductive member drums 40Y to 40K in accordance with image information of yellow, magenta, cyan, and black to form images of respect color toner images thereon. Further, on the opposite side of the tandem image formation section 20 to the intermediate transfer belt 10, there is provided a secondary transfer device 22 serving as a secondary transfer device. The secondary transfer device 22 includes an endless secondary transfer belt 24 wound around two rollers 231 and 232. The secondary transfer belt 24 pressure contacts the third supporting roller 16 via the intermediate transfer belt 10. Thus, the secondary transfer device 22 transfers the toner image on the intermediate transfer belt 10 onto a transfer sheet S serving as a printing medium. Further, on the left of the secondary transfer device 22, a fixing device 25 is arranged to fix the toner image onto the transfer sheets S.

The fixing device 1 includes a heating roller 7 serving as a heating device, an endless fixing belt 8 heated and suspended by fixing rollers 9, and a pressurizing roller 11 pressure contacting the fixing belt 8. The secondary transfer device 22 also includes a function to convey the transfer sheet S having received the toner image from the intermediate transfer belt 10 to the fixing device 25. As the secondary transfer device 22, a transfer roller or a non-contact transfer charge can be employed. Further, below the secondary transfer device 22 and the fixing device 25, there is also provided a sheet inversion device 28 in parallel to the tandem image formation section 20, which inverts the transfer sheet S and enables image formation on both sides thereof. When the copier makes an output, an original document is set onto an original document table 30 provided on the automatic document feeder 400. Otherwise, the automatic document feeder 400 is open and the original document is set onto a platen glass 32 arranged on the scanner 300 and then the automatic document feeder is closed to depress the original document. After that, when a start switch, not shown, is depressed, the original document is conveyed to the contact glass 32 when set onto the automatic document feeder 400. Otherwise, the scanner is immediately driven when the original document is set onto the platen glass 32. Then, first and second traveling members 33 and 34 are started running. Then, a light source emits light from the first traveling member 33 and reflects and directs the light to the second traveling member 34. Then, the second traveling member 34 reflects and leads the light to a reading sensor via an imaging lens 35 via a mirror so that the original document can be read.

In synchronism with reading of the original document, a drive motor, not shown, drives and rotates a drive roller 16. Thus, the intermediate transfer belt 10 travels clockwise as shown in the drawing, and two supporting rollers 14 and 15 are driven as the intermediate transfer belt 10 travels. Further, in synchronism with the same, drum photoconductive member 40Y to 40K are rotated in the respective image formation sections 18, and chargers 12 uniformly charge the surfaces of these. After that, exposure lights corresponding to information of respective colors are emitted onto the photoconductive members 40Y to 40K and whereby latent images are formed thereon. Subsequently, to the respective latent images, toner is supplied from the developing devices 13Y to 13K, whereby toner images are formed thereon. Then, the toner images on the photoconductive members 40Y to 40K are transferred and superimposed on the intermediate transfer belt 10 sequentially, whereby a synthesized color toner image is formed on the intermediate transfer belt 10. In this way, toner remaining on the respective photoconductive members 40Y to 40K after the transfer process of the respective color toner images onto the intermediate transfer belt 10 are removed by a cleaning device 19 as preparation for the next image formation.

In synchronism with the image formation, one of sheet feeding rollers 42 on the sheet-feeding tray 200 is selectively rotated, and a transfer sheet S is launched from one of the sheet feeding cassettes 44 arranged stepwise in a paper bank 43. The transfer sheets S are separated one by one by a separation roller 45, and are launched into a sheet-feeding path 46. The conveyance roller 47 conveys the transfer sheet S into a sheet-feeding path in the copier body so that the sheet S collides and stops at a registration roller 49. Then, in synchronism with a synthesized color toner image on the intermediate transfer belt 10, the registration roller 49 is rotated, and the transfer sheet S is launched between the intermediate transfer belt 10 and the secondary transfer device 22. Then, the second transfer device 22 transfers the color toner image onto the transfer sheet S. The transfer sheet S subjected to the toner image transfer process is conveyed and transferred by a secondary transfer belt 24 into a fixing device 25. The transfer sheet S receives pressure and heat from the fixing belt 8 and the pressurizing roller 11 in the fixing device 25 so that the transferred toner image is fixed. The transfer sheet S is ejected by a sheet ejection roller 56 while a switching pick 55 switches a direction thereof. Otherwise, the switching pick 55 switches the direction and guides the transfer sheet S into a sheet inversion device 28, so that the transfer sheet S is inverted and lead again to the transfer position. Then, an image is printed on the backside of the transfer sheet S and the transfer sheet S is ejected onto the sheet ejection tray 57.

Figure 2:
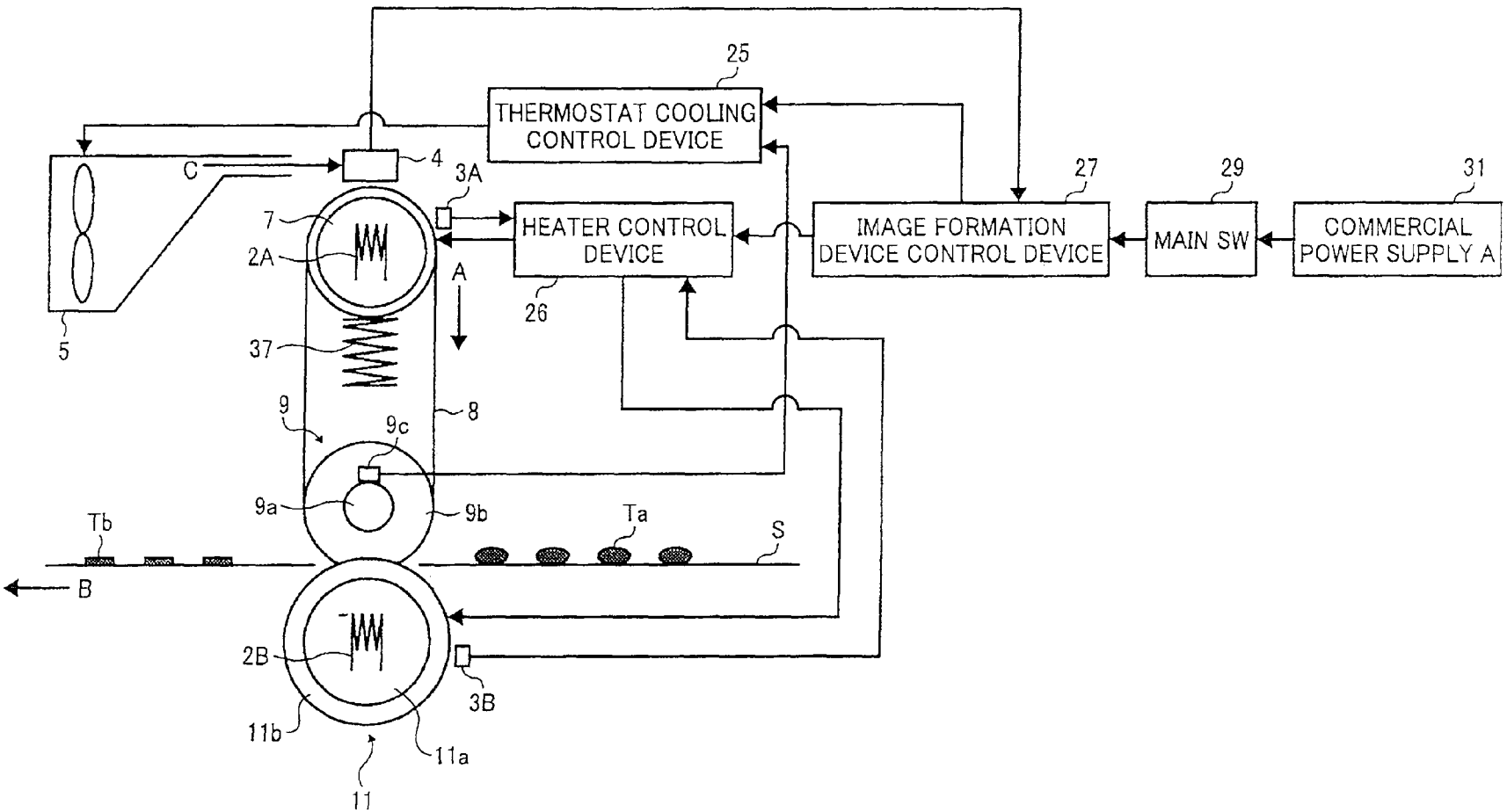
FIG. 2 schematically illustrates an exemplary fixing device according to one embodiment of the present invention.

The image forming apparatus in this embodiment is a high-speed machine in which a sheet conveyance speed (i.e., a process line speed) of a transfer sheet S is 352 mm/sec, and its productivity is about 75 cpm when a transfer sheet of A-4 size (JIS) is consecutively fed laterally. Further, the intermediate transfer belt 10 subjected to the toner transfer process is cleaned by an intermediate transfer belt cleaning device 17 that removes toner remaining thereon as preparation for the next image formation in the tandem image formation section 20 again. The registration roller 49 is frequently grounded typically. However, a bias can be provided to remove sheet dust. The drum type photoconductive member can be appropriately replaced with a belt type one Now, a first embodiment of a fixing device used in the above-mentioned image forming apparatus is described with reference to FIG. 2. As shown, the fixing device 1 includes a fixing belt 8, a fixing roller 9, a heating roller 7 as a heating member, a heater 2, a pressurizing roller 11 as a pressurizing member, a cooling fan 5 as a cooling device, and a temperature sensor 3 or the like. The fixing belt 8 is multilayered having a base layer made of resin, such as polyimide, etc., an elastic layer, and a releasing layer in this order. The fixing belt 8 includes an endless belt having a circumferential length of about 70 mm. The elastic layer of the fixing belt 8 is made of elastic material, such as fluorine rubber, silicone rubber, foam silicone rubber, etc. The releasing layer of the fixing belt 8 is made of PFA (4 ethylene fluoride Perfluoroalkyl vinyl ether copolymer resin) or the like. By arranging the releasing layer as a surface layer of the fixing belt 8, a releasing performance of releasing toner T can be maintained. The fixing belt 8 travels in a direction as shown by an arrow A of FIG. 2 being biased upwardly by a spring member 37 and the fixing roller 9, while suspended and supported by the heating roller 7 that provides a tension to the transfer belt 8. By employing a low heat capacity fixing belt as the fixing member, a temperature rise performance of the apparatus is improved, and whereby high-speed start up and prompt temperature adjustment are realized.

The fixing roller 9 includes a metal core 9*a* made of SUS 304 or the like, and an elastic layer 9*b* made of foam material, such as foam silicone rubber, etc., overlaying the metal core 9*a* and has an outer diameter of about 52 mm. The fixing roller 9 creates a nip by contacting the pressurizing roller 11 via the fixing belt 8 and rotates clockwise. By making the elastic layer of the foam material, a relatively large nip width can be obtained, so that heat can hardly make transition from the fixing belt 8 to the fixing roller 9. The heating roller 7 is made of metal material, such as aluminum, stainless steel, etc., and has a hollow structure (e.g. a cylindrical member), in which a heater 2A as a heat source is secured. By making the thickness of the heating roller 7 not more than 1 mm, the heat capacity of the heating roller decreases and as a result, a temperature rise performance can be improved. Specifically, a start up time is shortened. The heating roller 7 is made of aluminum and has a thickness of about 0, 6 mm and an outer diameter of about 35 mm.

The heater 2A of the heating roller 7 includes a halogen heater secured to side plates of the fixing device at its both ends, respectively. Then, when a main switch 29 included in the image forming apparatus body is turned on, a commercial power supply 31 (A) serving as a first power supply supplies power to the heater 2A via a control section 27 of the image forming apparatus body and a heater control section 26. Then, due to radiation of heat from the heater 2A controlled by the heater control section 26, the heating roller 7 is heated.

Further, the surface of the fixing belt 8 heated by the heating roller 7 applies the heat to a toner image T on the transfer sheet S. An output from the heater 2A is controlled based on a detection result of a temperature sensor 3A (e.g. a thermopile) serving as a belt surface temperature detection device arranged opposing the surface of the fixing belt 8. Specifically, alternating current is supplied as power distribution to the heater 2A for a prescribed time period determined in accordance with the detection result of the temperature sensor 3A. By such output control, the temperature of the fixing belt 8 is adjusted at around a prescribed target level. The above-mentioned heater has power of 1200 rated watt. Thus, by increasing the total watt number of the heater 2A, a start up time period of the apparatus (i.e., a warm up time period) can be shortened.

The pressurizing roller 11 includes a metal core 11*a* and an elastic layer 11*b* overlying an outer circumferential of a metal core 32 via an adhesive layer. The elastic layer 11*b* of the pressurizing roller 11 is made of material, such as foam silicone rubber, fluorine rubber, silicone rubber, etc. The elastic layer includes a thin releasing layer made of PFA or the like as a surface layer. The pressurizing roller 11 pressure contacts the fixing roller 9 via the fixing belt 8 while being biased by a pressurizing mechanism, not shown. In this way, a prescribed nip is created between the pressurizing roller 11 and the fixing belt 8. Pressure of the pressurizing mechanism can either be removed or decreased. Further, to improve heating efficiency of the fixing belt 8, the pressurizing roller 11 includes a heater 2B. Then, a heater control device 26 controls temperature of the heater 2B in accordance with a detection output of a temperature sensor 3B that detects surface temperature of the pressurizing roller 11. Further, control temperatures of the heating roller 7 and pressurizing roller are set to be about 170 and 150 degree centigrades, respectively, during a warm-up state (i.e., an operation stop time) of the fixing device 1. Whereas when a sheet is conveyed (i.e., during an operation time), they are set to be about 165 and 120 degree centigrades, respectively. The thus configured fixing device 1 operates as follows. When the main switch 29 of the image forming apparatus body is turned on, the commercial power supply A31 serving as a first power supply provides an alternating current voltage to the heater 2A. At same time, the fixing belt 8 (i.e., the fixing roller 9 and the heating roller 7) and the pressurizing roller 11 starts rotating in a direction as shown by an arrow. The commercial power supply A31 also serves as a power supply source for devices other than the fixing device 1, such as an image formation section, a sheet feeding section, a conveyance section, etc. Then, the transfer sheet S is fed from the sheet feeding cassette 44 and receives each of the toner images of mono colors on the photoconductive members 40Y to 40K as a not fixed toner image Ta. The transfer sheet S with the not fixed toner image is conveyed to a direction as shown by an arrow B by rotational transportation of the conveyance belt 24 as shown in FIG. 1. Thus, the transfer sheet S enters the nip between the fixing belt 8 and the pressurizing roller 11. Then, the toner image Ta is fixed onto the surface of the transfer sheet S by the heat transmitted from the fixing belt 8 and the depression force created between the fixing belt 8 and the pressurizing roller 11. Then, the transfer sheet S is launched from the nip by the fixing belt 8 and the pressurizing roller 11, and is conveyed in a direction as shown by an arrow B carrying the fixed toner image Tb.

In the vicinity of the heating roller 7, there is provided a thermostat 4 serving as an excessive temperature rise prevention device. The thermostat 4 is cooled by air blown from a cooling fan 5 in a direction as shown by an arrow C. Power supply from a commercial power supply A31 to the cooling fan 5 is controlled by a thermostat cooling control device 25 and an image forming apparatus control device 27. Thus, the cooling fan 5 turns on and off, accordingly. When a signal instructing stop of rotational is inputted from a rotation detection device 9*c* that detects rotation of a rotation shaft (i.e., a metal core) 9*a* of the fixing roller 9, the thermostat cooling control device 25 rotates and drives the cooling fan 5 for a prescribed time period, for example 60 seconds, to blow cooling air to the thermostat 4. Thus, when the fixing roller 9 is stopped rotating, specifically, a transfer sheet S is not conveyed by the fixing belt 8 or the pressurizing roller 11, the thermostat cooling control device 25 causes the cooling fan 5 to cool the thermostat 4. Accordingly, when the fixing device 1 is turned off and a printing medium is not conveyed as an operation stop condition, the thermostat 4 is cooled for a prescribed time period and an operation thereof is prevented. As a result, forcible cutting off of power distribution to the heating roller 7 caused when the thermostat 4 erroneously operates as shown in FIG. 3 can be prevented.

As understood from FIG. 3, even when the power is turned off and thereby the transfer sheet S is not conveyed by the fixing belt 8, the temperature of the heating roller 7 temporality increases and then gradually decreases as shown by a curvature 5 in FIG. 3. This is because the temperature of the heating roller 7 is not absorbed by the transfer sheet S even the power distribution to the halogen heater 2 is stopped.

Further, temperature of the thermostat 4 decreases from when the rotation detection device 9*c* detects stop of sheet passage (Y2) and the cooling fan 5 starts operating and cools the thermostat 4 to when the cooling fan 5 stops operation after a prescribed time period (e.g. 60 seconds) has elapsed (Y3). Then, the temperature of the thermostat 4 increases as that of the heating roller 7 increases as shown by a curvature 6 in FIG. 3. However, since the temperature of the thermostat 4 does not reach an operation temperature X thereof, the forcible cut off operation of the halogen heater 2 of the fixing roller 7 generally caused by an erroneous operation of the thermostat 4 can be appropriately prevented. As a result, when the main switch 29 is turned on and the image forming apparatus control device 27 is activated, the halogen heater 2 can appropriately heat the heating roller 7.

Further, when the halogen heater 2 goes out of control and the heating roller 7 does not stop heating whereby heating temperature increases, and thereby overshoot occurs, the thermostat 4 appropriately operates and the power distribution to the halogen heater 2 is forcibly cut off. Thus, abnormal temperature increase of the heating roller 7 can be stopped.

Now, forcible cut off of the power distribution to the halogen heater 2 executed by the thermostat 4 when over shoot occurs is described with reference to FIG. 4. Temperature of the thermostat 4 decreases as indicated by a curvature 7, when the rotation detection device 9*c* detects stop of sheet passage (Y5) and the cooling fan 5 operates and cools the thermostat 4 for a prescribed time period (Y6). However, as temperature of the heating roller 7 increases due to the out of control of the halogen heater 2 as indicated by a curvature 8, temperature of the thermostat 4 increases to a level X1 and reaches the operable level X. Then, the thermostat 4 reaches an operable level X1 and forcibly cuts off the power distribution to the halogen heater 2, and whereby causing the heating roller 7 to stop heating. As a result, damage on the fixing device due to the over shoot can be appropriately prevented.

Figure 5:
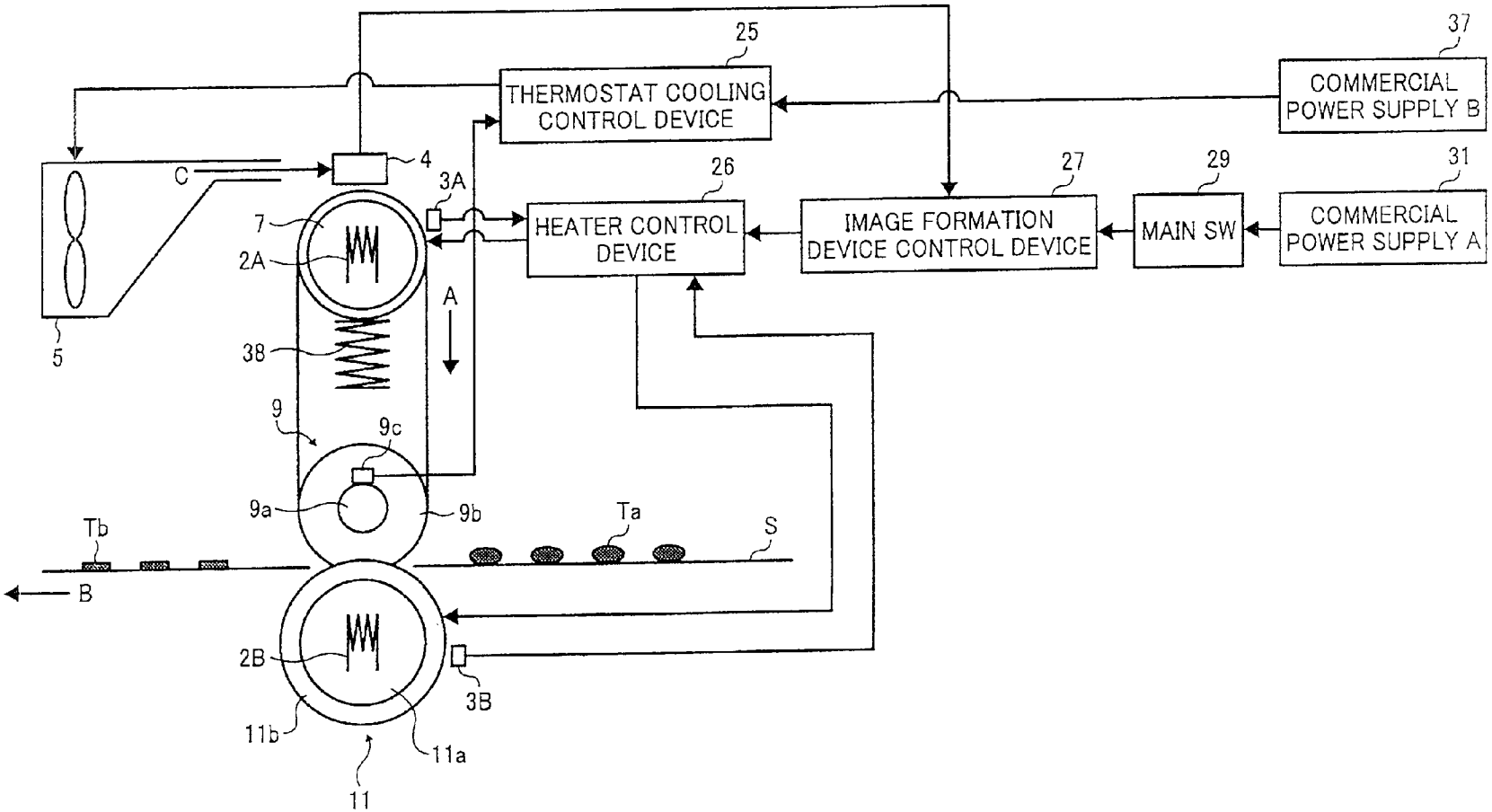
FIG. 5 schematically illustrates an exemplary fixing device according to a second embodiment of the present invention.

Now, a second embodiment of a fixing device is described with reference to FIG. 5. As shown, different from the first embodiment, a commercial power supply B37 is used as a power supply to supply power to the thermostat cooling control device 25 in this fixing device instead of the commercial power supply A31 as in the first embodiment. Accordingly, ether when sheet jam occurs on a conveyance path for a transfer sheet S at the time of image formation or when the power service stops and the power supply to the image formation control device 27 is cut off, the thermostat cooling control device 25 can appropriately operate and cool the thermostat 4. Because, the thermostat cooling control device 25 can be operated by the power supply B37 independent from the power supply A31 that generally operates the image formation control device 27.

Figure 6:
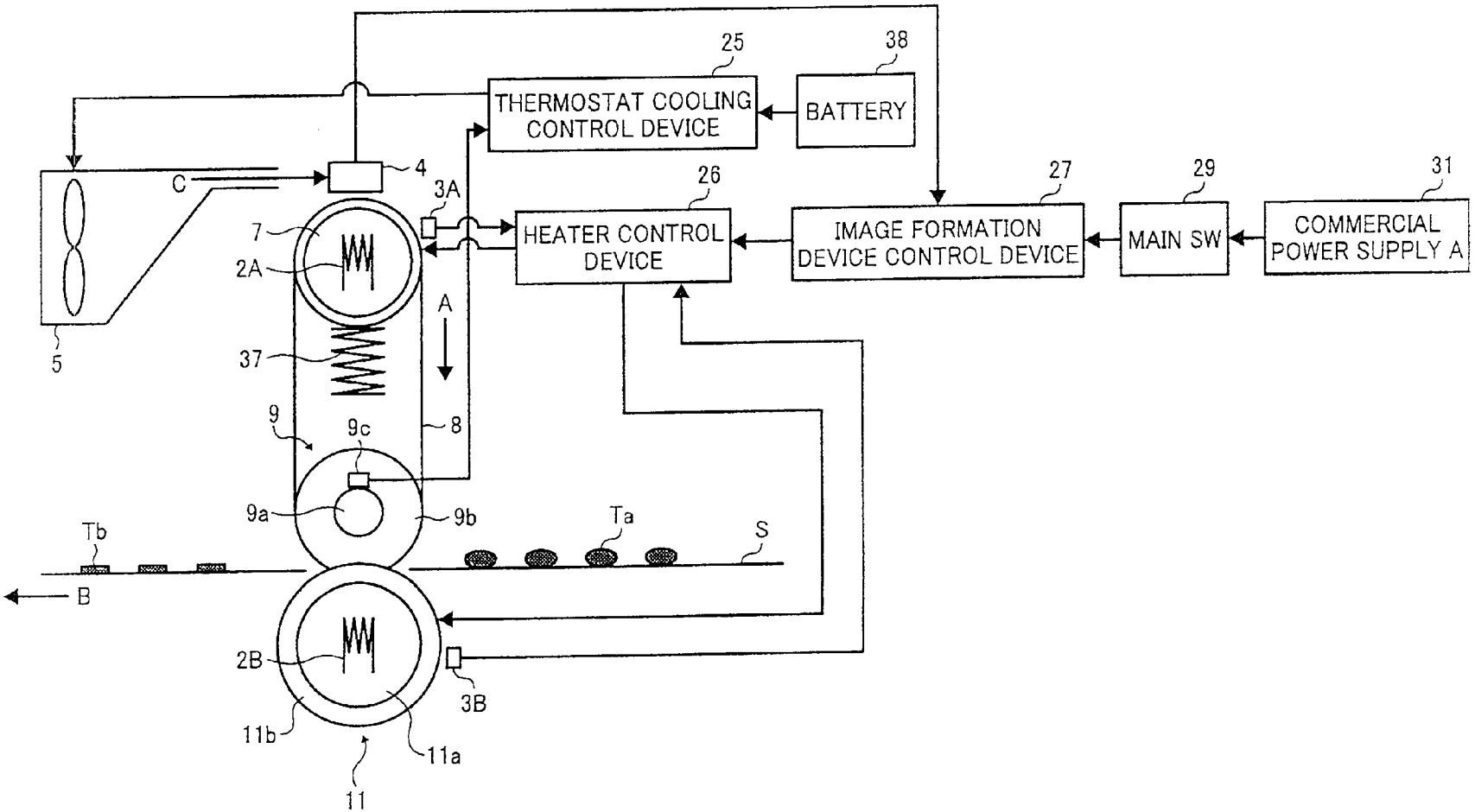
FIG. 6 schematically illustrates an exemplary fixing device according to a third embodiment of the present invention.

Now, a third embodiment of a fixing device is described with reference to FIG. 6. As shown, different from the second embodiment, a battery, such as a primary battery, a rechargeable secondary battery, etc., can be employed in the fixing device instead of the commercial power supply B37. Accordingly, even when the power service stops during image formation, the thermostat cooling control device 25 can appropriately operate and cools the thermostat 4. Thus, the erroneous operation of the thermostat 4 can be prevented.

Figure 7:
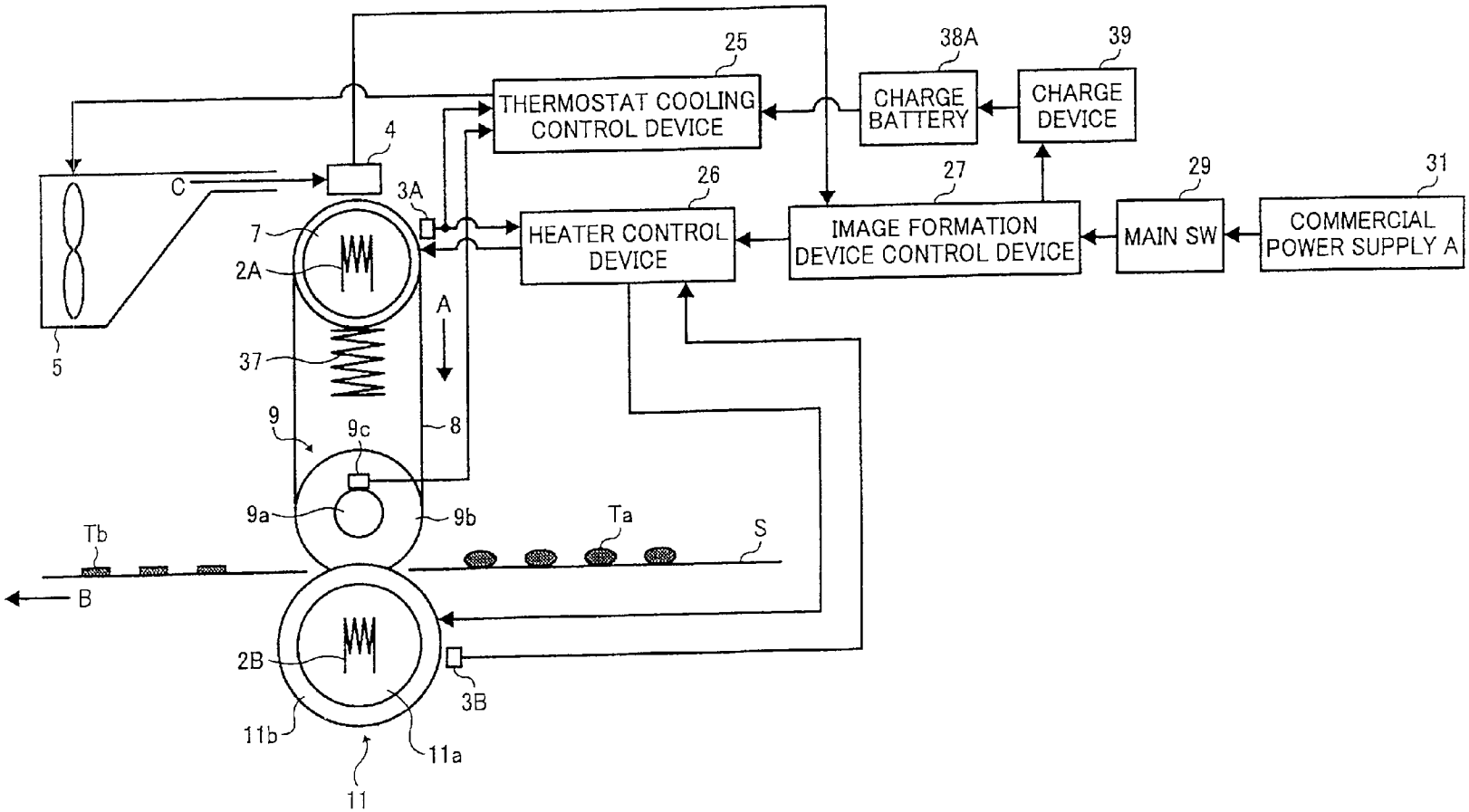
FIG. 7 schematically illustrates an exemplary fixing device according to a fourth embodiment of the present invention.
Figure 10:
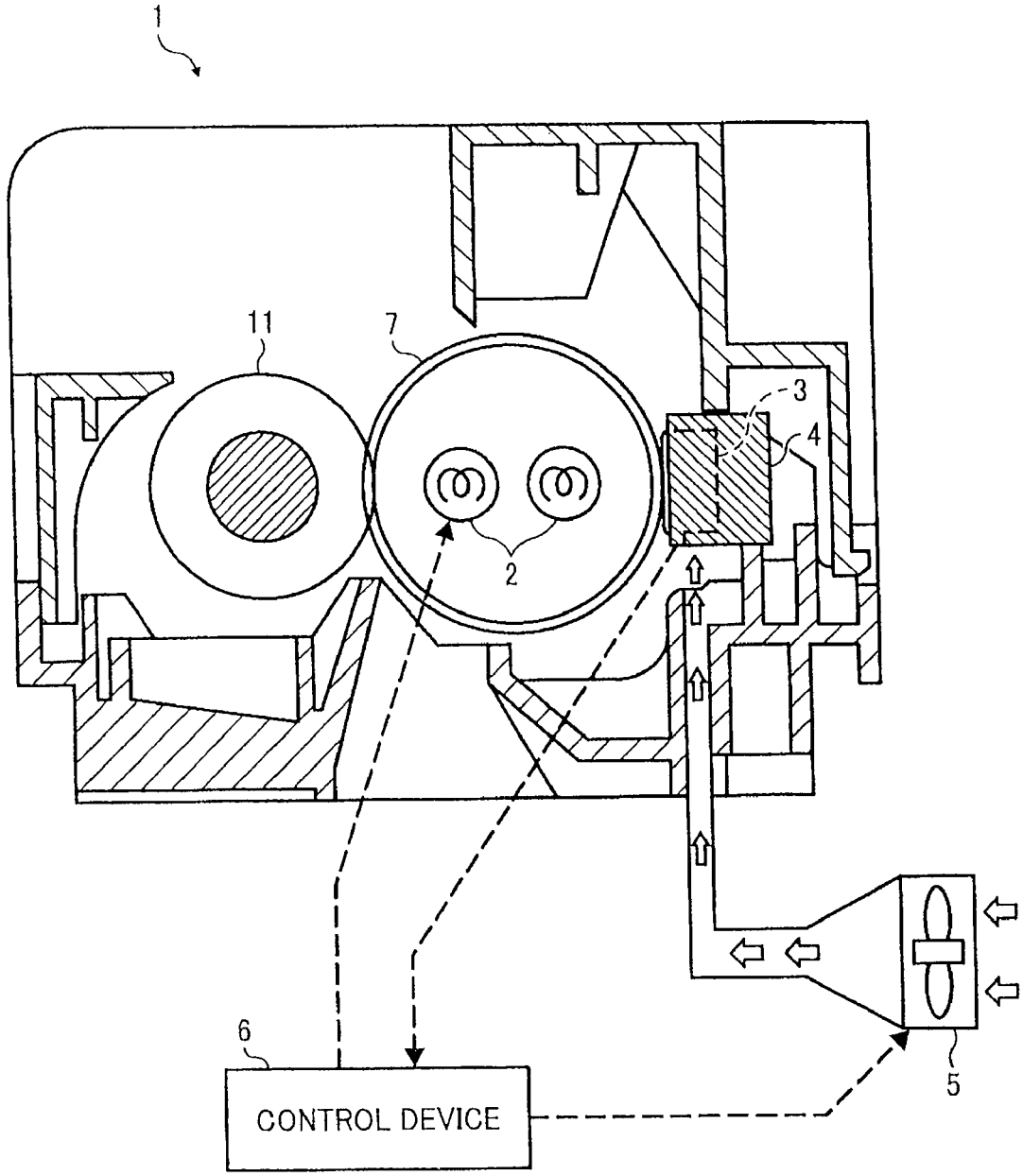
FIG. 10 schematically illustrates a conventional fixing device.
Figure 11:
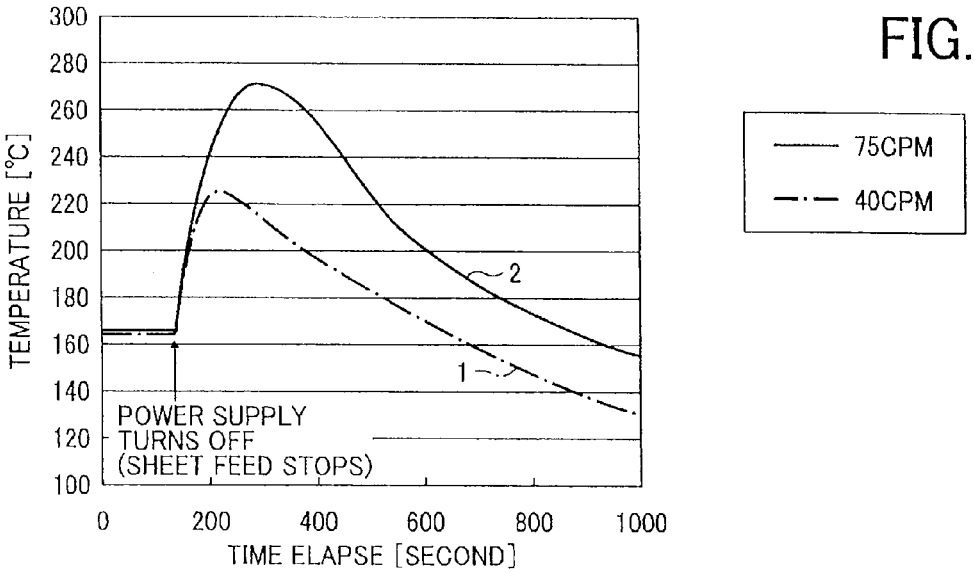
FIG. 11 illustrates temperature change of a heating roller of the conventional fixing device when overshoot occurs.
Figure 12:
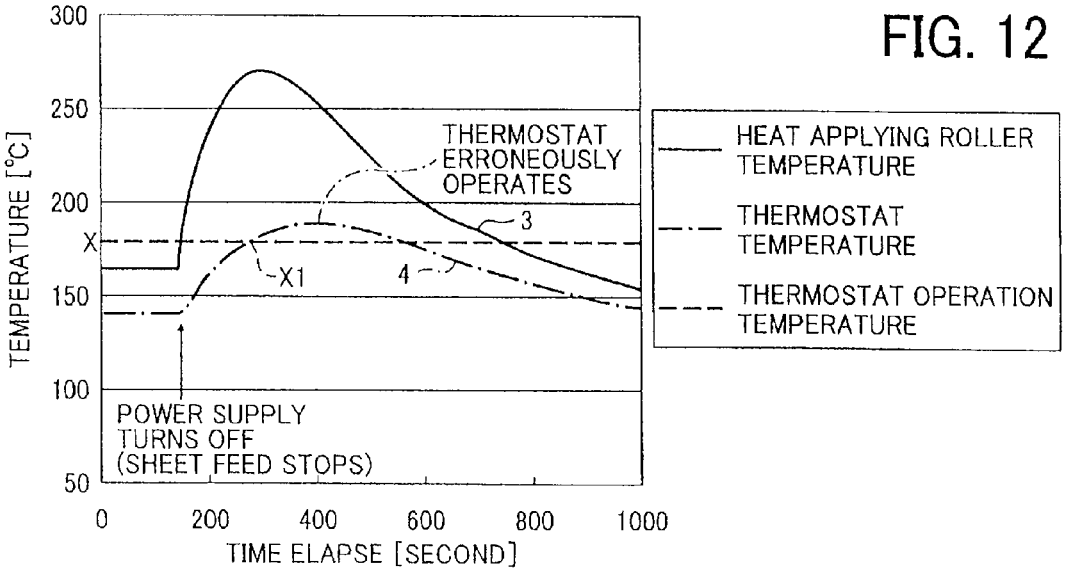
FIG. 12 illustrates temperature change of a heating roller and a thermostat arranged in the conventional fixing device.

Now, a forth embodiment of a fixing device is described with reference to FIG. 7. As shown, a battery, such as a rechargeable secondary battery 38*a*, etc., is employed in the fixing device to operate thermostat cooling control device 25. Further, a charging device 39 is installed in the image forming apparatus to charge the rechargeable battery 38*a*. As a power supply for the charging device 39, a commercial power supply A31 that supplies power to the image forming apparatus control device 27 is used. Thus, since the charging device 39 is installed in the image forming apparatus while the commercial power supply A31 for the charging device 39 is utilized, the rechargeable battery is not necessarily detached from the image forming apparatus when the rechargeable battery 38*a* is drained and recharged. As a result, the thermostat cooling control device 25 can be appropriately operated.

Further, as shown, a detection temperature signal representing temperature of the heating roller 7 transmitted from the temperature detection device 3A is inputted to the thermostat cooling control device 25. Thus, when temperature of the heating roller 7 reaches a prescribed level (Z1), for example 200 degree centigrade, the cooling fan is controlled to start operating and automatically stops when a prescribed time period (e.g. 60 seconds) has elapsed thereafter. Accordingly, as shown in FIG. 8, when consecutive printing is normally completed and the last sheet S of the consecutive printing is ejected, the fixing belt 8 keeps rotating for 200 seconds thereafter as a countermeasure against the over shoot and then stops rotating (called a unit stop). Thus, the cooling fan 5 does not operate, because temperature of the heating roller 7 as indicated by a curvature 9 does not reach an air blow operation start temperature Z1 (e.g. 200 degree centigrade). As a result, needless consumption of the rechargeable battery 38*a* to be used for operating the cooling fan 5 can be suppressed. Further, since the temperature of the thermostat 4 does not reach the operation temperature X (see, curvature 10), and the thermostat does not operate, forcible cutting off of the power distribution to the halogen heater 2A caused by an erroneous operation of the thermostat can be prevented, and occurrence of the overshoot during the unit stop can be appropriately suppressed.

Further, when temperature of the heating roller 7 reaches a prescribed level Z2 (e.g. 280 degree centigrade) and a temperature detection signal thereof is transmitted from the temperature detection device 3A, the cooling fan 5 is controlled to stop blowing air by regarding that the heater 2A goes out of control. Specifically, as shown in FIG. 9, when temperature of the heating roller 7 increases up to an ON operation temperature Z1, the cooling fan 5 starts blowing air and cools the thermostat 4 and decreases temperature as indicated by the curvature 11 to avoid over shoot problem. When temperature of the heating roller 7 further increases and reaches the OFF operation temperature Z2, the cooling fan stops air blowing to avoid the problem of out of control of the heater 2A. Specifically, when temperature of the thermostat 4 increases thereafter and reaches the operation temperature X as indicated by a curvature 12, the thermostat 4 starts operation and forcibly cuts off the power distribution to the halogen heater 2A as originally expected. As a result, overshoot and out of control problems can be suppressed. Since the thermostat cooling control device 25 is controlled to turn on and off in accordance with temperature of the heating roller 7, the thermostat 4 can be precisely operated, and abnormal temperature increase can be avoided.

Instead of using the pressurizing roller 11 as a pressurizing member, a pressurizing belt, a pressurizing pad, and a mechanism including a pressurizing pad and an endless belt freely rotating on the pressurizing pad as a transfer sheet S travels, and so on can be used to obtain the same result. Further, the present invention can also be applied to a fixing device that employs a fixing roller serving as a heating member by its own instead of the fixing belt while obtaining the same result. Further, the present invention can also be applied to a fixing device that employs an electromagnetic induction heating system to heat the heating member instead of the heater 2A that heats by means of heat radiation while obtaining the same result. Further, instead of using the cooling fan 5 to cool the heating member, a heat pipe engageable with the heating member and the like can be employed. In such a situation, by engaging and disengaging the heat pipe with the heating member under control of a secondary power supply, the same effect can be obtained.

Numerous additional modifications and variations of the present invention are possible in light of the above teachings. It is therefore to be understood that within the scope of the appended claims, the present invention may be practiced otherwise that as specifically described herein.

ADVANTAGE

According to one embodiment of the present invention, an excessive temperature rise prevention device can appropriately prevent overshoot, and an erroneous operation of the excessive temperature rise prevention device can also be suppressed even when a printing operation is stopped.

What is claimed is:

1. A fixing device, comprising:

a heating member configured to heat an unfixed toner image on a printing medium;

a conveyance device configured to convey the printing medium launched from the heating member after the heating member heats the unfixed toner image;

a heat temperature detection device configured to detect heat temperature of the heating member;

an excessive temperature rise prevention device configured to forcibly cut off power distribution to the heating member when the heat temperature reaches an abnormal level;

a cooling device configured to cool the excessive temperature rise prevention device;

a cooling device control device configured to control the cooling device to cool the excessive temperature rise prevention device when the conveyance device stops a conveyance operation;

a heating member use power supply configured to supply power to the heating member; and a cooling device control device use power supply configured to supply power to the cooling device control device, said cooling device control device use power supply being provided independently from the heating member use power supply.

2. The fixing device as claimed in claim 1, wherein said cooling device control device use power supply includes a battery.

3. The fixing device as claimed in claim 1, wherein said cooling device control device use power supply includes a rechargeable battery, further comprising a charging device configured to charge the rechargeable battery, and wherein said charging device being supplied with power from the heating member use power supply.

4. The fixing device as claimed in claim 1, wherein said cooling device is controlled to stop operation when the heat temperature not more than a prescribed first level is detected.

5. The fixing device as claimed in claim 4, wherein said prescribed first level is detected when over shoot of temperature occurs in the heating member.

6. The fixing device as claimed in claim 1, wherein said cooling device is controlled to stop operation when the heat temperature not less than a prescribed second level is detected.

7. The fixing device as claimed in claim 6, wherein said prescribed second level is detected when the heating member goes out of control.

8. An image forming apparatus comprising:

a toner image forming device configured to form a toner image on a sheet; and a fixing system including the fixing device as claimed in claim 1.

* * * * *